US009399862B2

(12) United States Patent
Gallardo Chaparro et al.

(10) Patent No.: US 9,399,862 B2
(45) Date of Patent: Jul. 26, 2016

(54) ODOR EXTRACTOR

(71) Applicants: Cesar Rigoberto Gallardo Chaparro, El Paso, TX (US); Rogelio Gallardo Chaparro, El Paso, TX (US)

(72) Inventors: Cesar Rigoberto Gallardo Chaparro, El Paso, TX (US); Rogelio Gallardo Chaparro, El Paso, TX (US)

( * ) Notice: Subject to any disclaimer, the term of this patent is extended or adjusted under 35 U.S.C. 154(b) by 575 days.

(21) Appl. No.: 13/856,662

(22) Filed: Apr. 4, 2013

(65) Prior Publication Data

US 2014/0298576 A1 Oct. 9, 2014

(51) Int. Cl.
*E03D 9/04* (2006.01)
*E03D 9/05* (2006.01)

(52) U.S. Cl.
CPC ..... *E03D 9/05* (2013.01)

(58) Field of Classification Search
CPC ..... E03D 9/05
USPC ..... 4/213
See application file for complete search history.

(56) References Cited

U.S. PATENT DOCUMENTS

| | | | |
|---|---|---|---|
| 3,120,665 | A | 2/1964 | Kirkland |
| 3,585,651 | A | 6/1971 | Cox |
| 3,733,619 | A | 5/1973 | Smith |
| 4,017,916 | A | 4/1977 | Pearson |
| 5,199,111 | A | 4/1993 | Antepenko |
| 5,305,472 | A | 4/1994 | Eger |
| 5,488,741 | A | 2/1996 | Hunnicutt, Jr. |
| 6,694,534 | B2 | 2/2004 | Stone |
| 2006/0021120 | A1 | 2/2006 | Nickle |
| 2011/0047689 | A1 | 3/2011 | Gianelloni |
| 2012/0227170 | A1 | 9/2012 | Ineson et al. |
| 2012/0260414 | A1 | 10/2012 | Lee |

FOREIGN PATENT DOCUMENTS

| | | | |
|---|---|---|---|
| KR | 20-0251116 | Y1 | 11/2001 |
| KR | 10-2009-0043778 | A | 5/2009 |

OTHER PUBLICATIONS

PCT International Search Report for PCT/US2013/035243 dated Jul. 25, 2013.

*Primary Examiner* — Tuan N Nguyen
(74) *Attorney, Agent, or Firm* — Luis M. Ortiz; Kermit D. Lopez; Ortiz & Lopez, PLLC

(57) ABSTRACT

An improved odor extracting apparatus and system are disclosed. The disclosed embodiments provide an exhaust vacuum for a toilet with associated venting installed through existing walls, windows, ceilings, or other outlets. The exhaust apparatus suctions air and aerosol particles from the toilet bowl to prevent lingering odor in the restroom and areas proximate to the restroom. Embodiments of the disclosed odor extractor are installed either independently of the toilet seat or incorporated in the toilet seat manufacturing process. Exemplary models fit any make of toilet seat and are interchangeable between toilet seats. The disclosed odor extractor is low in both noise and vibration.

16 Claims, 15 Drawing Sheets

ODOR EXTRACTOR

CROSS REFERENCE TO RELATED APPLICATIONS

This patent application claims the benefit under 35 U.S.C. §119(a) of Mexican Patent Application Serial No. MX/u/2012/000202 filed on May 9, 2012 and entitled "EXHAUST FAN FOR TOILET," which is hereby incorporated by reference in its entirety.

FIELD OF THE INVENTION

The disclosed embodiments relate to odor extraction. The disclosed embodiments further relate to a vacuum filtration and ventilation system for a toilet. The disclosed embodiments also relate to an odor extraction system with an integrated air filter.

BACKGROUND

People consider their excremental functions private. While private, restrooms in homes and public restrooms fail to ventilate odorous air. The offensive odor is typically diffused throughout the restroom and other indoor spaces. Those in close proximity to the restroom are subjected to offensive odors for prolonged periods of time. Previous attempts to compensate for stagnant restroom air using air fresheners, for example, fail to properly disperse odors. Air in the restroom often becomes contaminated prior to reaching exhaust fans installed in a restroom's ceiling. An additional problem with the common toilet is that odors accumulate before the toilet can be flushed. Additionally, conventional flushing toilet bowls release a fine mist or aerosol. Such a mist or aerosol contains objectionable odor as well as potentially harmful bacteria and viruses spread throughout the adjacent area.

Therefore, a need exists for an improved toilet ventilation system and method to efficiently remove odors before disbursement into the restroom and areas proximate to a restroom.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide for an improved odor extractor.

It is another aspect of the disclosed embodiments to provide for an improved vacuum filtration and ventilation system for a toilet.

It is a further aspect of the disclosed embodiments to provide for an improved odor extraction system with an integrated air filter.

The above and other aspects can be achieved as is now described. An improved odor extracting apparatus and system are disclosed. An example embodiment can provide an exhaust vacuum for a toilet with associated venting installed through existing walls, windows, ceilings, or other outlets. The exhaust apparatus suctions air and aerosol particles from the toilet bowl to prevent lingering odor in the restroom and areas proximate to the restroom. An example embodiment of the disclosed odor extractor can be installed either independently of the toilet seat or incorporated in the toilet seat manufacturing process. Exemplary models fit any make of toilet seat and are interchangeable between toilet seats. The disclosed odor extractor is low in noise and vibration.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
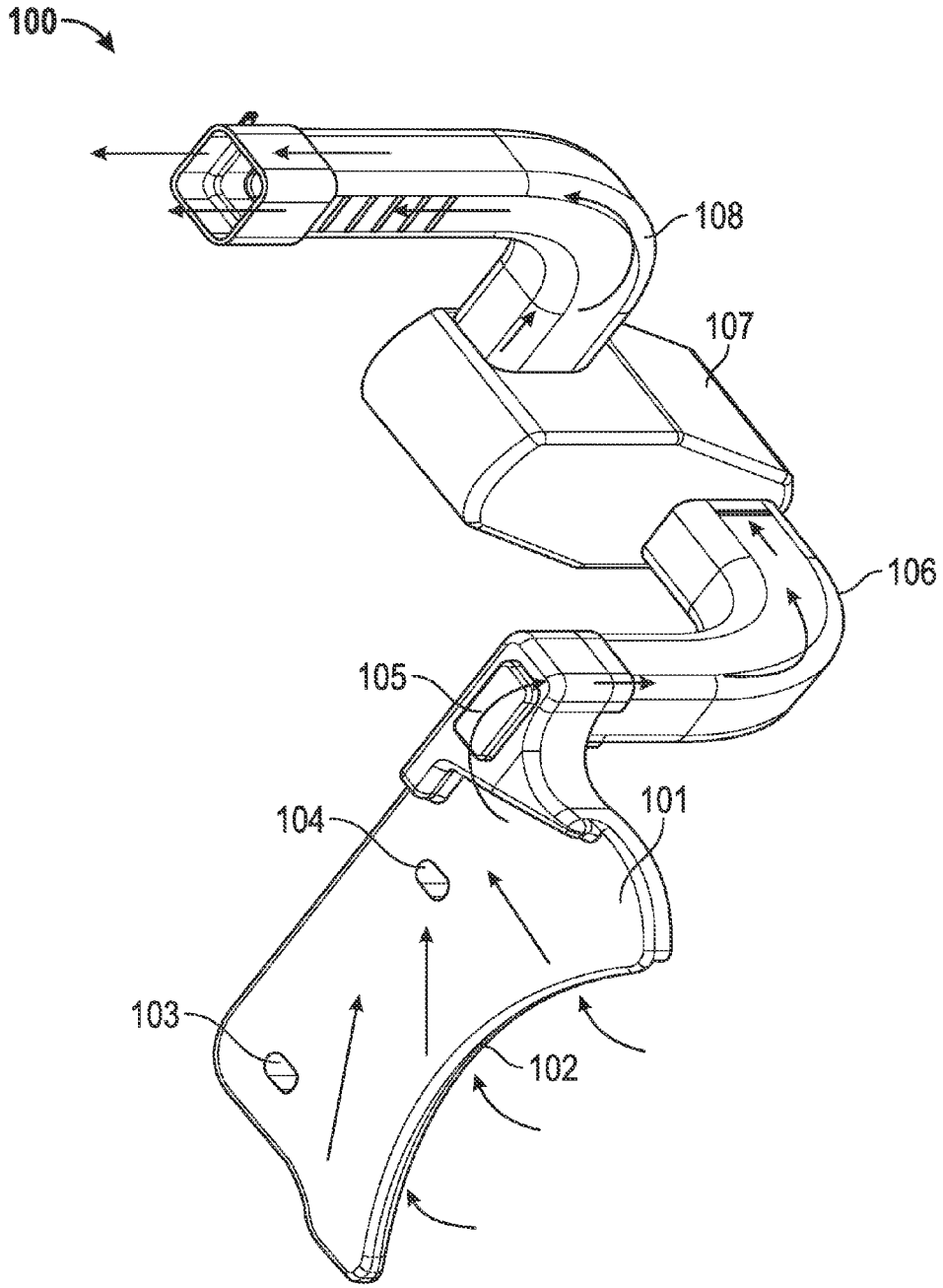
FIG. 1 illustrates an exemplary schematic view of an odor extraction apparatus, according to a preferred embodiment.

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the invention are shown. The embodiments disclosed herein can be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout. As used herein, the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Current wall or ceiling ventilation fails to instantly extract odors and smells. Instead, odors disburse throughout the restroom and/or nearby rooms, leaving a feeling of discomfort to the user's own smells. The disclosed embodiments provide an exhaust fan and/or exhaust vacuum and odor extractor for a toilet. The odor extractor's nozzle is located between the toilet and the seat of the toilet, subsequently connecting ventilating conduit to an exhaust. The associated ventilation system is located on at least one side of the toilet. Embodiments of the disclosed odor extractor further comprise an extraction nozzle which has an air flow groove located in front thereof. The extraction nozzle is placed as physically close as possible to the source of odors, i.e., between the toilet seat and the toilet.

A connector is located at the back of the extraction nozzle to connect the nozzle to an odor extractor duct. The duct is connected at the opposing end to an air extractor. The air extractor comprises a switch at the output of the extractor connected chute which expels odors from the toilet towards the outside environment. The exhaust fan operates via a manual switch or an automatic sensor that senses when a restroom user is close to the toilet. The automatic sensor can be located on the extraction nozzle, anywhere on the odor extractor apparatus or system, and/or anywhere in the restroom, either freestanding or mounted, to detect use entry and/or use of the toilet. The manual switch can be placed at the entrance of the restroom or located on a component of the disclosed odor extractor apparatus or system. The manual switch can be activated by a restroom user prior to using the toilet or during use of the toilet. The associated vent pump is preferably an electric pump with a turbine engine. The disclosed odor extractor is low in noise and vibration.

FIG. 1 illustrates a schematic view 100 of an odor extraction apparatus, according to a preferred embodiment. The odor extractor apparatus 101, installed between the toilet bowl and toilet seat, is electrically operated and suctions air, aerosol particles, and/or bacteria through an open vacuum space 102 of the odor extractor 101. Vacuum space 102 of odor extractor apparatus 101 is installed towards a toilet bowl and sucks in air and particles as indicated by the arrows in FIG. 1. The odor extractor system, method, and apparatus suction an air stream in close proximity to the toilet bowl and odor source, thus preventing odor from escaping the toilet bowl area and surrounding restroom area. When the odorous particles are removed from the source through the vacuum space 102, lingering odor does not permeate the restroom and surrounding spaces. Embodiments of the disclosed odor extractor are installed either independently of the toilet seat through holes 103 and 104, or incorporated in the toilet seat manufacturing process.

To install the apparatus on a toilet, holes 103 and 104 are sized to fit through existing hardware on most standard toilet seats. Exemplary models fit any make of toilet seat and are interchangeable between toilet seats. Manual switch 105 can be depressed by the user of the toilet to start the vacuum while the toilet is in use. Vent 106 connects the odor extractor 101 to vacuum pump 107. Vacuum pump 107 is attached to an exterior vent 108 to direct odor and particles out of the restroom area through venting installed in a floor, ceiling, wall, or window, for example.

Figure 2:
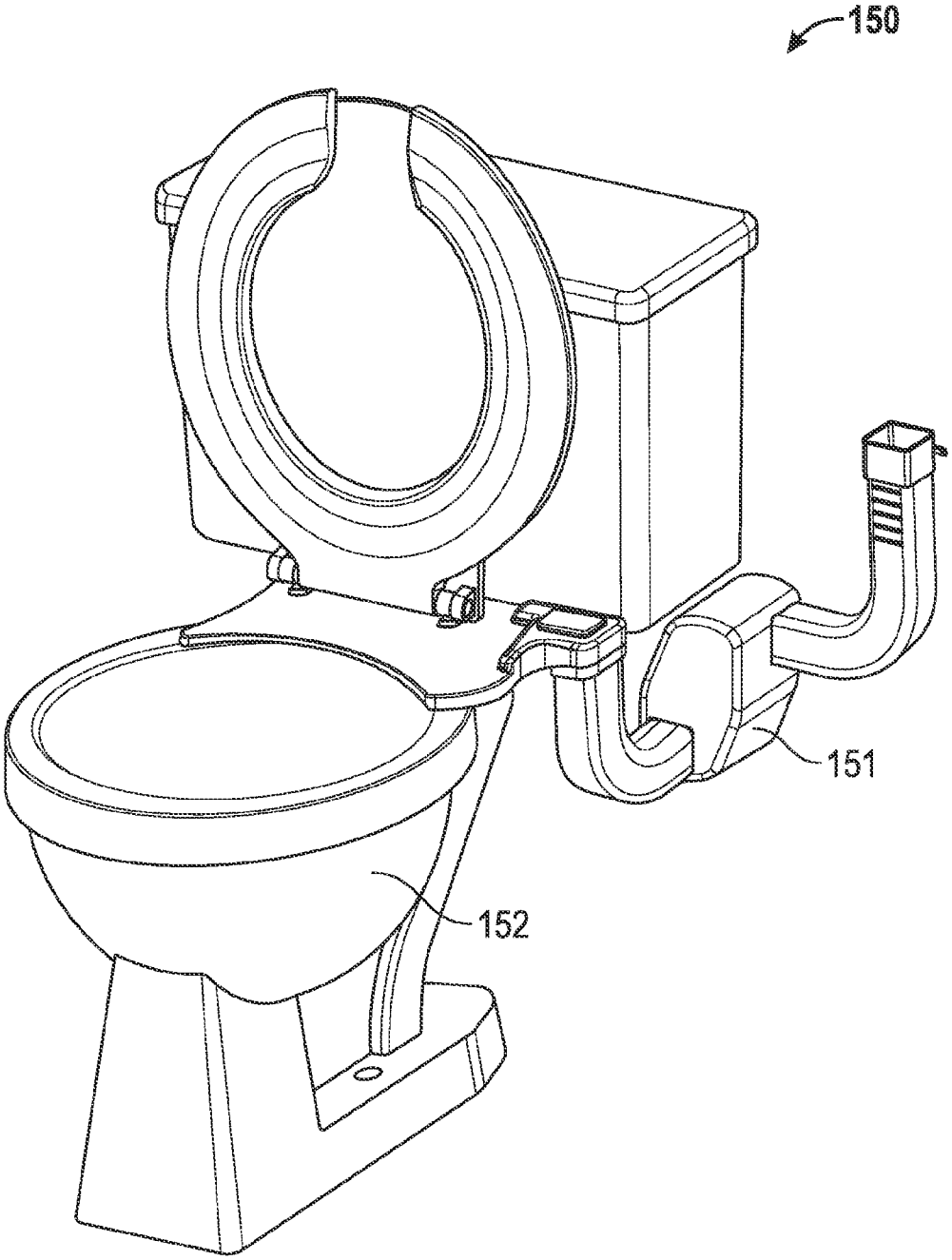
FIG. 2 illustrates an exemplary pictorial illustration of the odor extraction system, according to an embodiment.

FIG. 2 illustrates an exemplary pictorial illustration 150 of the odor extraction system, according to an embodiment. The odor extractor apparatus 151 is installed on toilet 152. With the odor extractor vacuum placed between the toilet's 152 bowl and seat, the odor extractor vacuum is in close proximity to the odors to prevent escape into the air of the restroom, while remaining sanitary.

Figure 3:
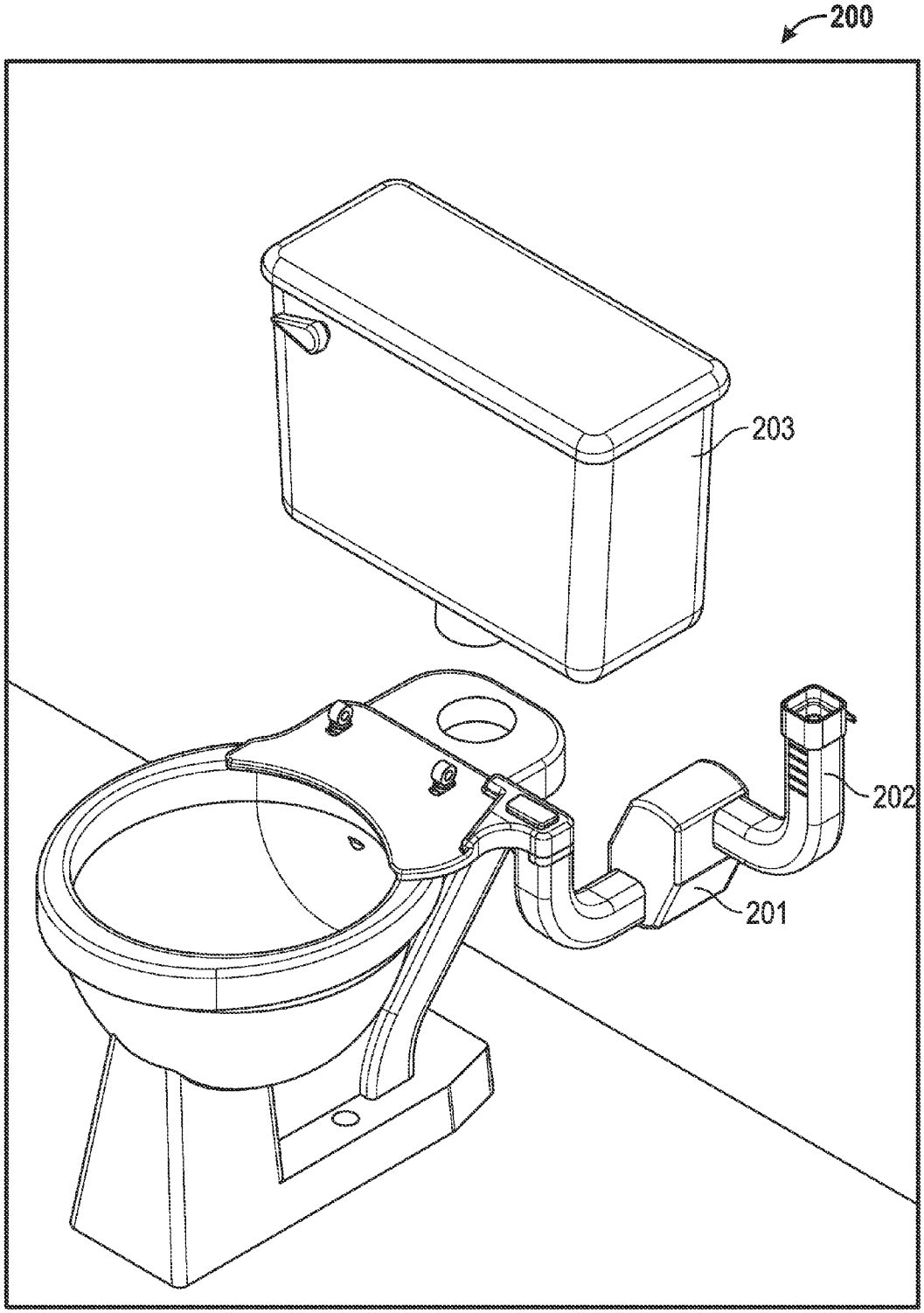
FIG. 3 illustrates an exemplary schematic view of the odor extractor system and vertical ventilation outlet, according to an embodiment.
Figure 4:
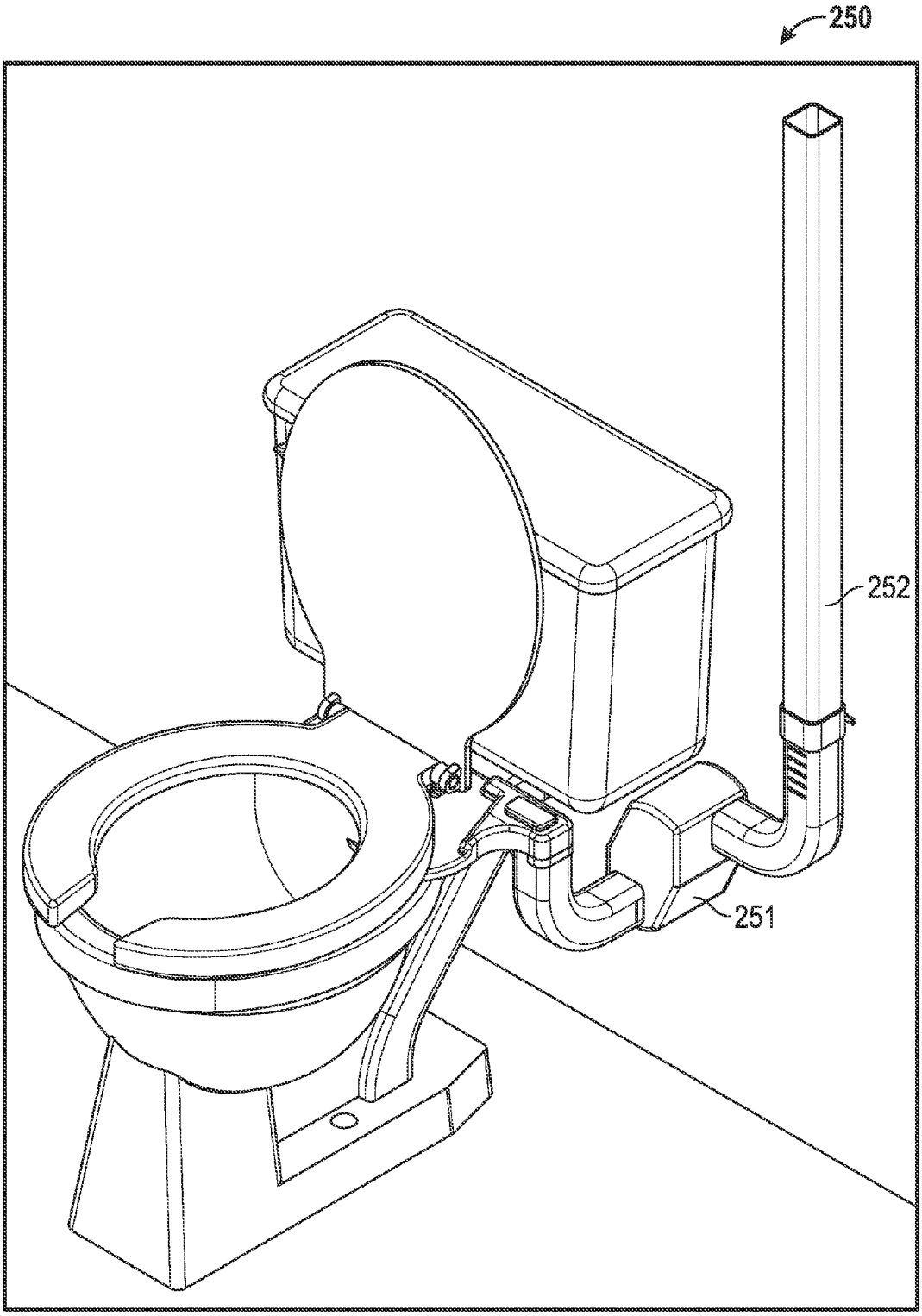
FIG. 4 illustrates an exemplary pictorial illustration of the odor extractor system and exterior wall-mounted vertical ventilation outlet, according to an embodiment.
Figure 5:
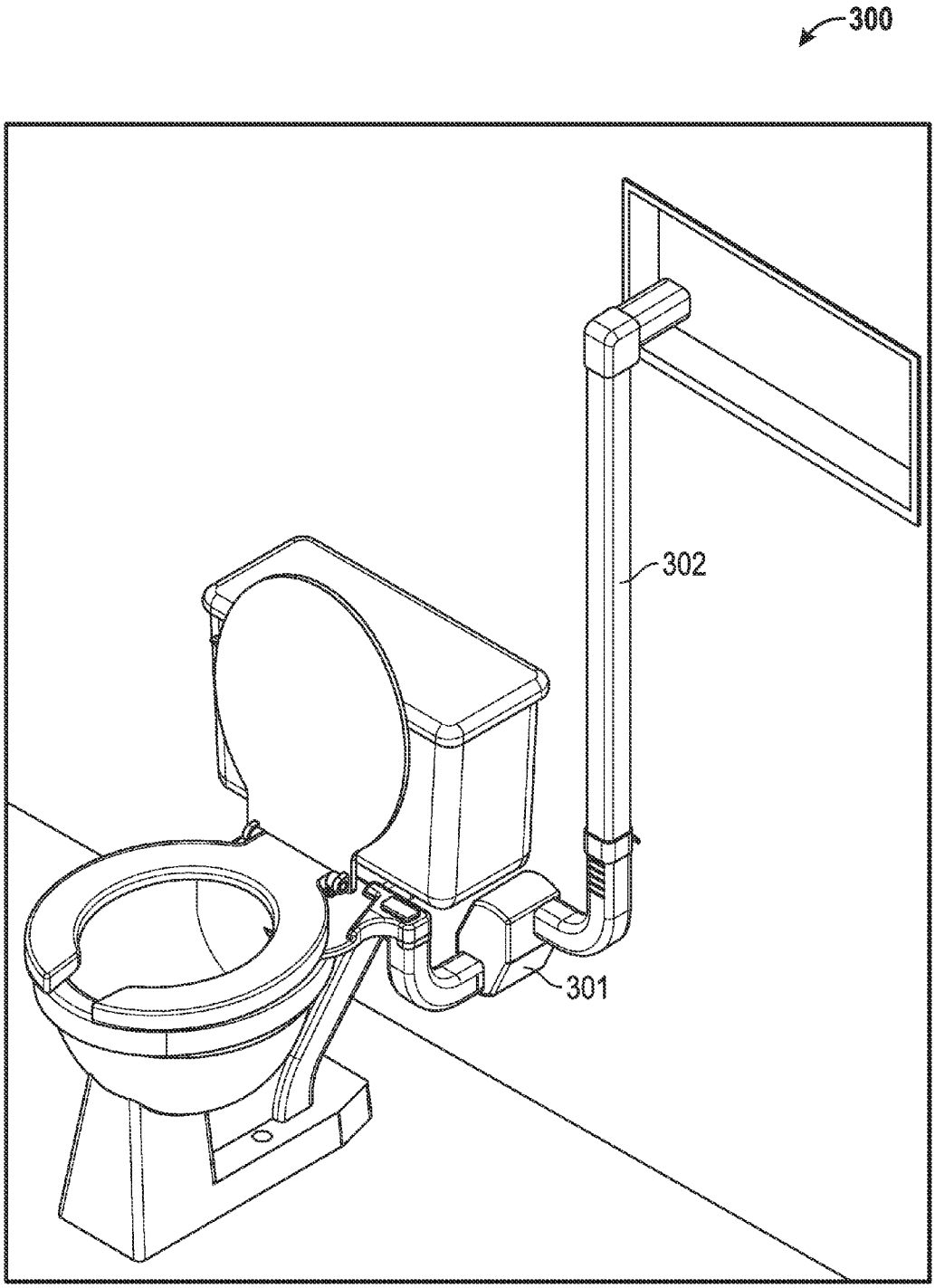
FIG. 5 illustrates an exemplary pictorial illustration of the odor extractor system and window-mounted vertical ventilation outlet, according to an embodiment.

Restroom odors are expelled towards the outside environment through a duct exhaust outlet by means of suction created by a pump interconnected to the odor extraction nozzle. FIG. 3 illustrates an exemplary schematic view 200 of the odor extractor system and vertical ventilation outlet 202, according to an embodiment. The odor extractor apparatus 201 is installed on a toilet with a vertical ventilation outlet 202. Tank 203 is raised with the installed odor extractor apparatus 201 for illustrative purposes only. The vertical ventilation outlet 202 allows attachment of additional conduit to ventilate odors through a wall-mounted conduit or window-mounted conduit (not illustrated). For example, FIG. 4 illustrates a pictorial illustration 250 of an exterior wall-mounted, vertical ventilation conduit 252 connected to the odor extractor apparatus 251, according to an embodiment. The exterior wall-mounted, vertical ventilation conduit 252 can extend the length of the wall through a hole in the ceiling to vent to an outside environment, or through multiple lengths of conduit in a multiple-level building. An exemplary pictorial illustration 300 of the window-mounted conduit 302 is illustrated in FIG. 5. The odor extractor apparatus 301 is mounted to the toilet and vents odors through vertical ventilation outlet 202 that spans the length of the exterior of a restroom wall. The conduit for the odor ventilation is preferably plastic or PVC. It is understood that the conduit or tubing can comprise any suitable material and is not limited to plastic embodiments.

Figure 6:
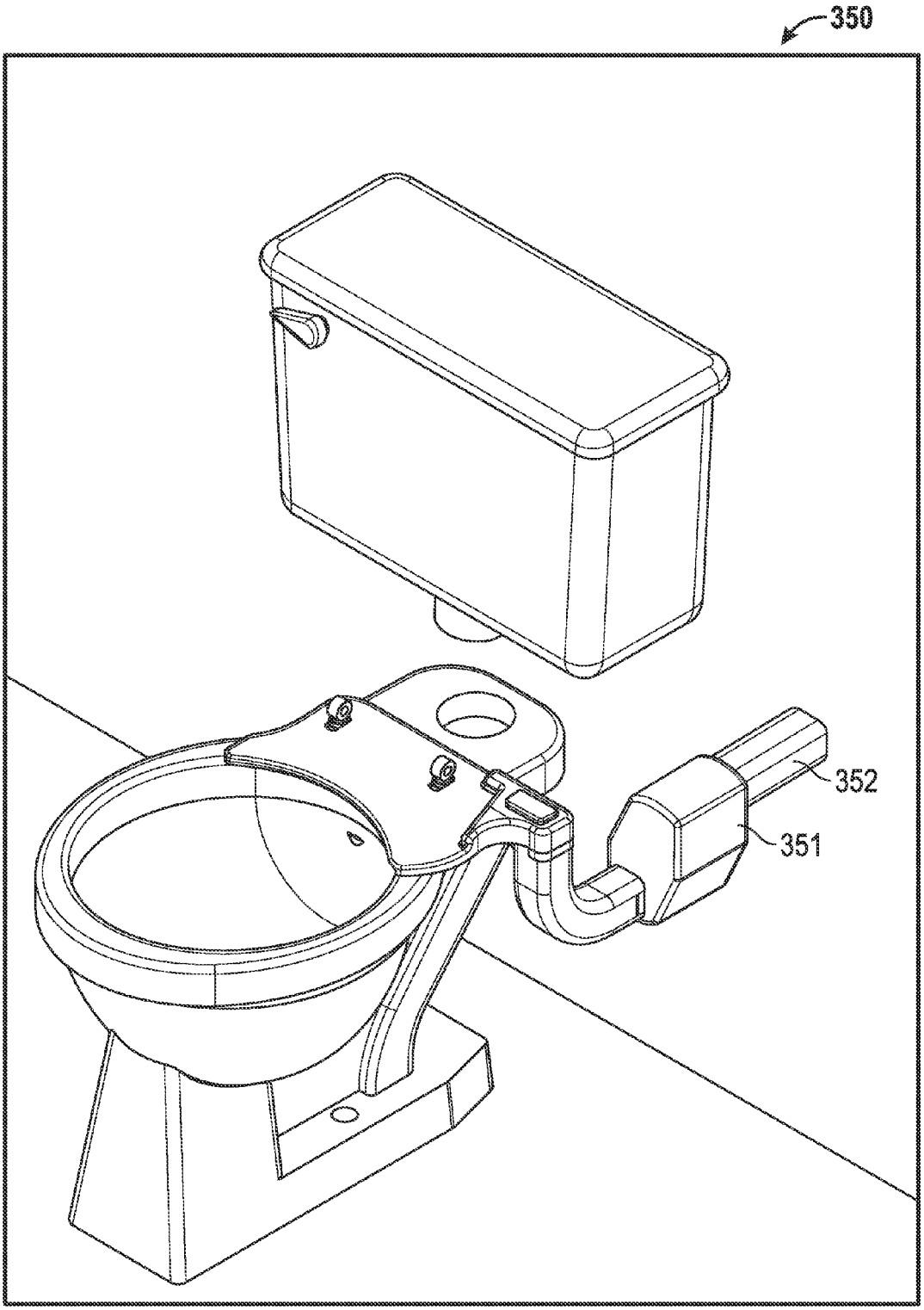
FIG. 6 illustrates an exemplary schematic view of the odor extractor system and horizontal ventilation outlet, according to an embodiment.
Figure 7:
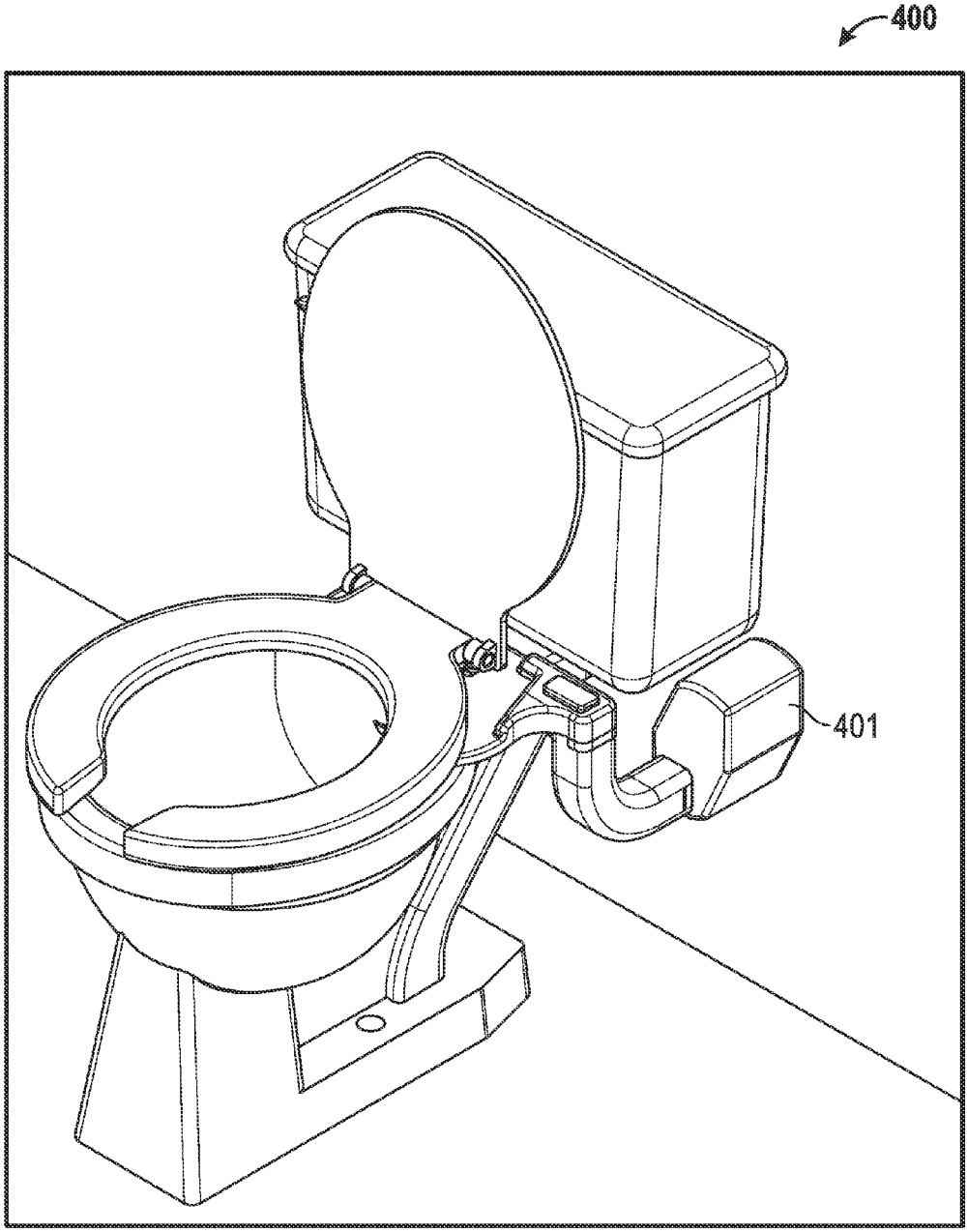
FIG. 7 illustrates an exemplary pictorial illustration of the odor extractor system and horizontal ventilation outlet, according to an embodiment.

FIG. 6 illustrates an exemplary schematic view 350 of the odor extractor system and horizontal ventilation outlet 352, according to an embodiment. Horizontal ventilation outlet 352 exits the odor extractor apparatus 351 and enters a hole in the restroom wall, as illustrated in an exemplary pictorial illustration 400 in FIG. 7. Ventilation occurs through additional conduit within the restroom wall or directly to an outside environment.

Figure 8:
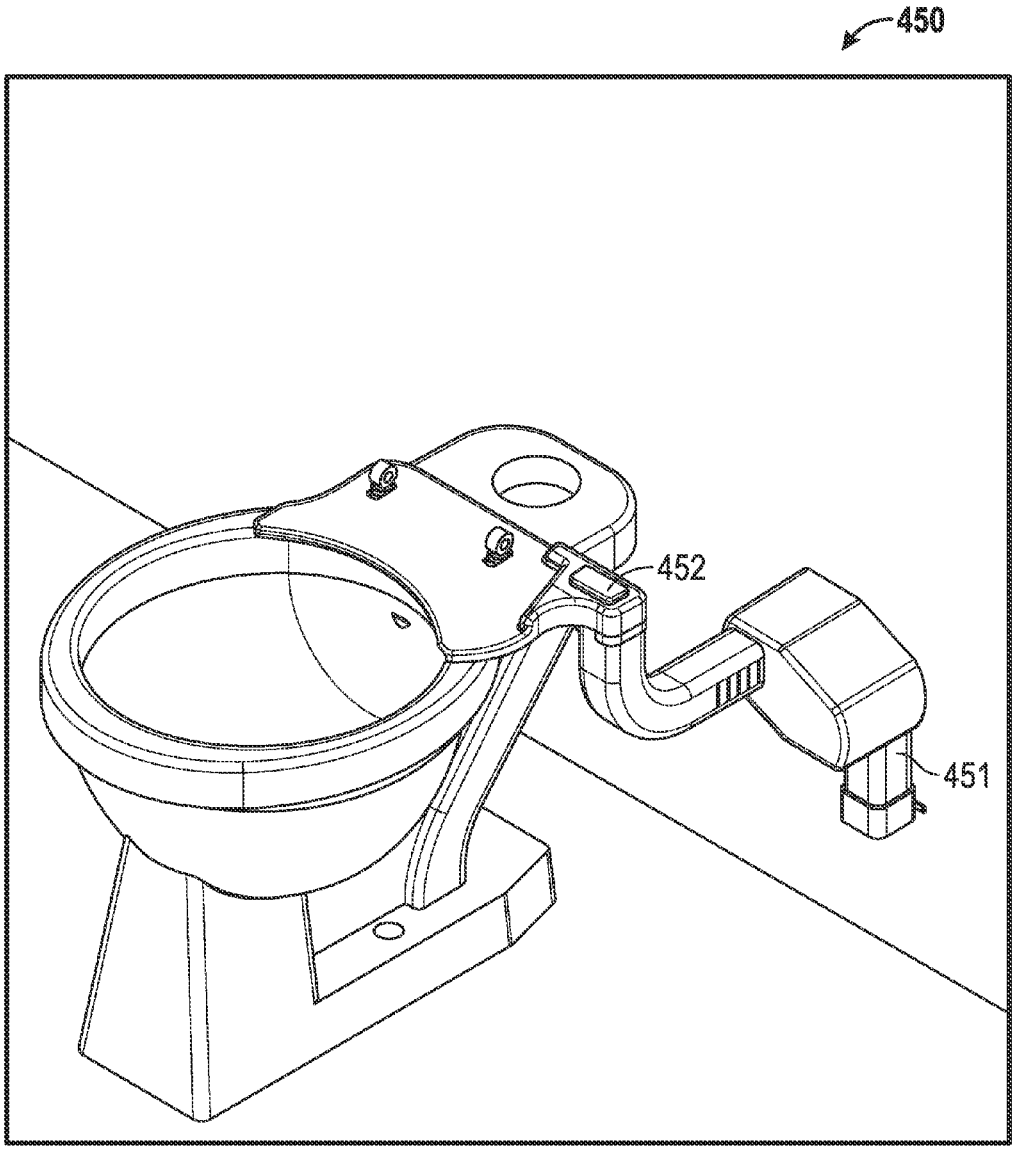
FIG. 8 illustrates an exemplary schematic view of the odor extractor system, floor-facing ventilation outlet, and manual switch, according to an embodiment.
Figure 9:
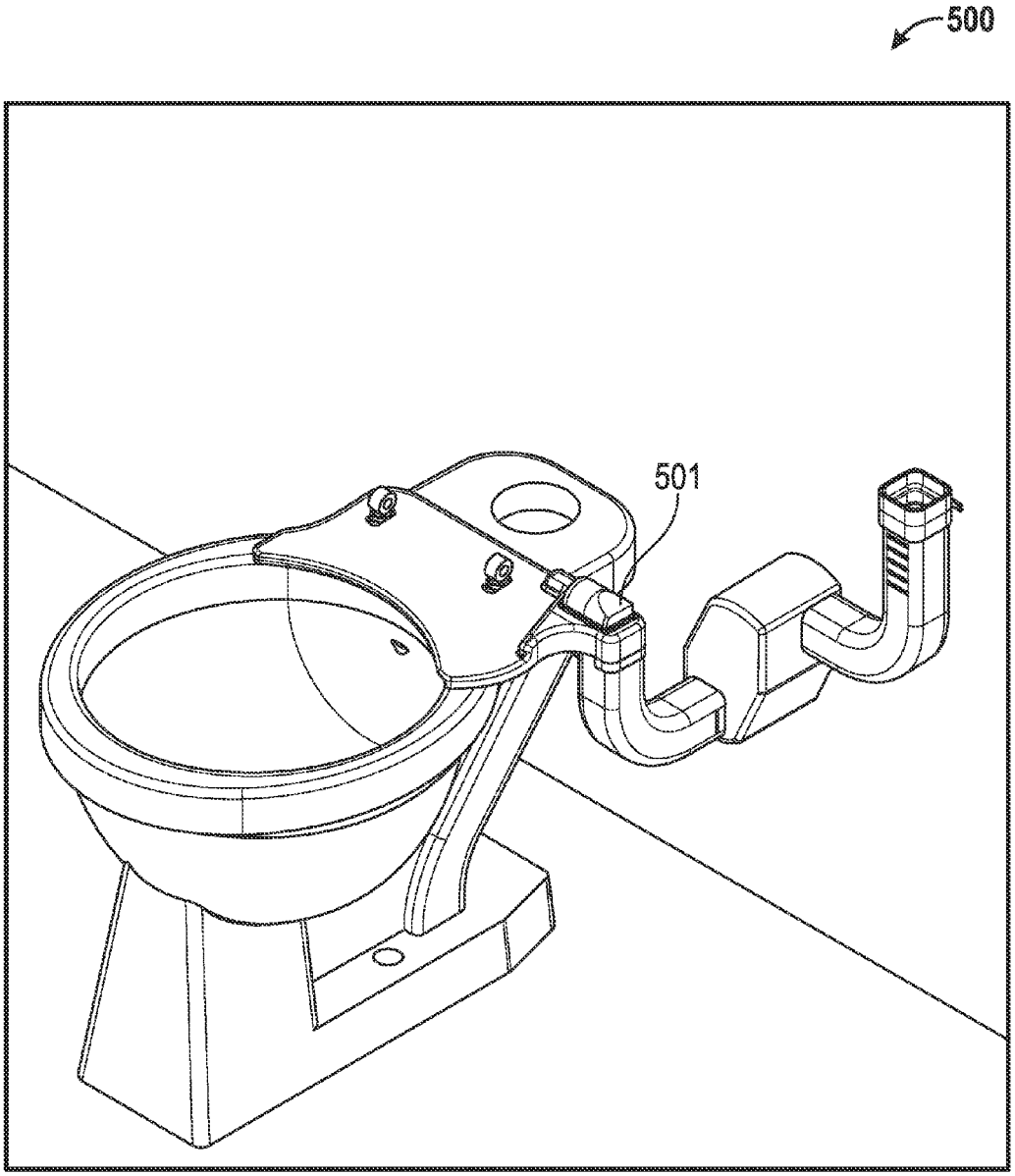
FIG. 9 illustrates an exemplary schematic view of the odor extractor system, vertical ventilation outlet, and automatic control sensor, according to an embodiment.

FIG. 8 illustrates an exemplary schematic view 450 of the odor extractor system, floor-facing ventilation outlet, and manual switch, according to an embodiment. Ventilation 451 for the odor extractor faces towards the restroom floor to exit through the floor. Manual switch 452 to operate the odor extractor is depressed before or during use of the toilet. An automatic sensor 501, as illustrated in exemplary schematic view 500 in FIG. 9, can automatically detect when a user enters the restroom or is in close proximity to the toilet and starts the odor extractor vacuum. The user does not have to depress a manual switch 452 when automatic sensor 501 operates the odor extractor system. The odor extractor system saves energy when operated on an automatic sensor as it turns on only when the toilet is in use and for some time after toilet use, based on a programmed operation time.

Figure 10:
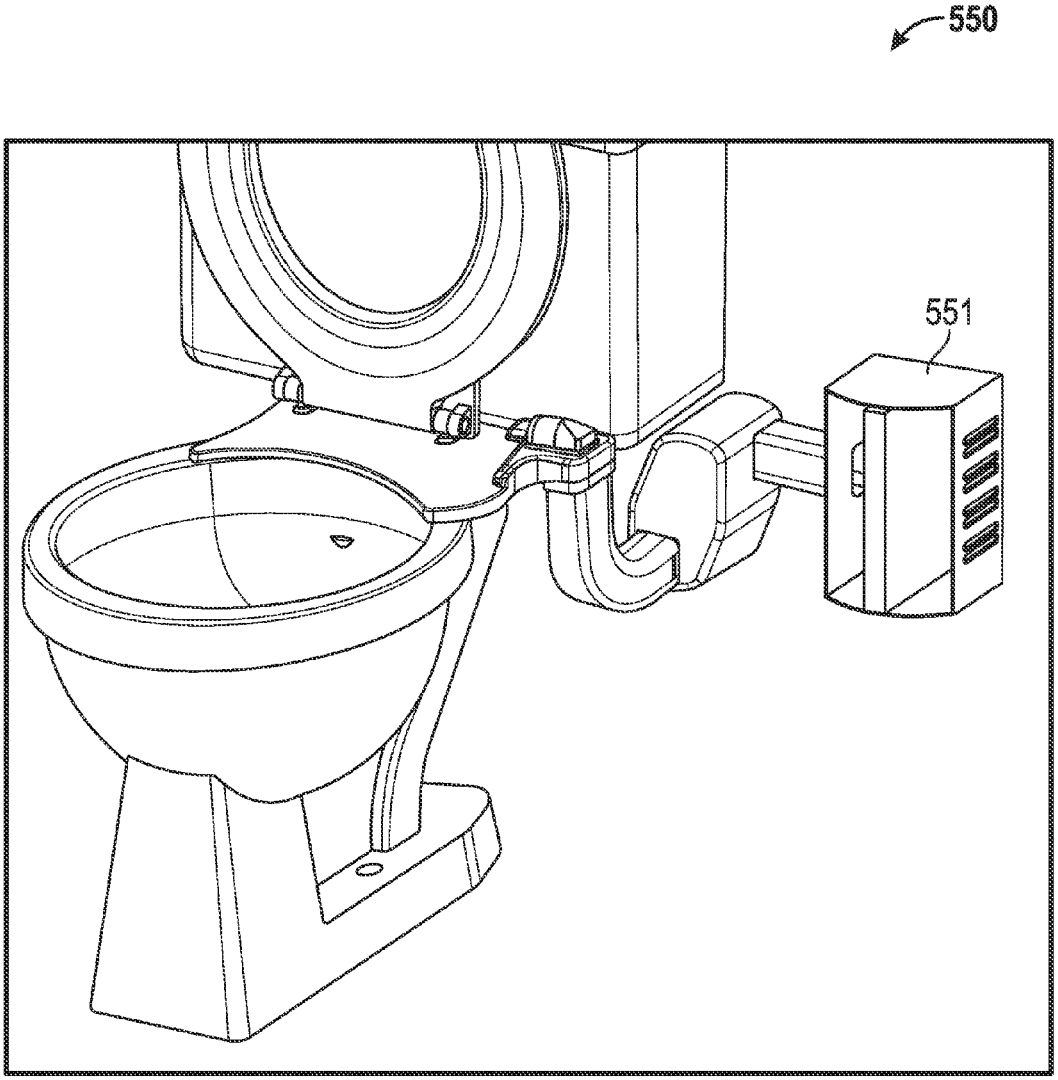
FIG. 10 illustrates an exemplary schematic view of the odor extractor system and associated air filter, according to an embodiment.
Figure 11:
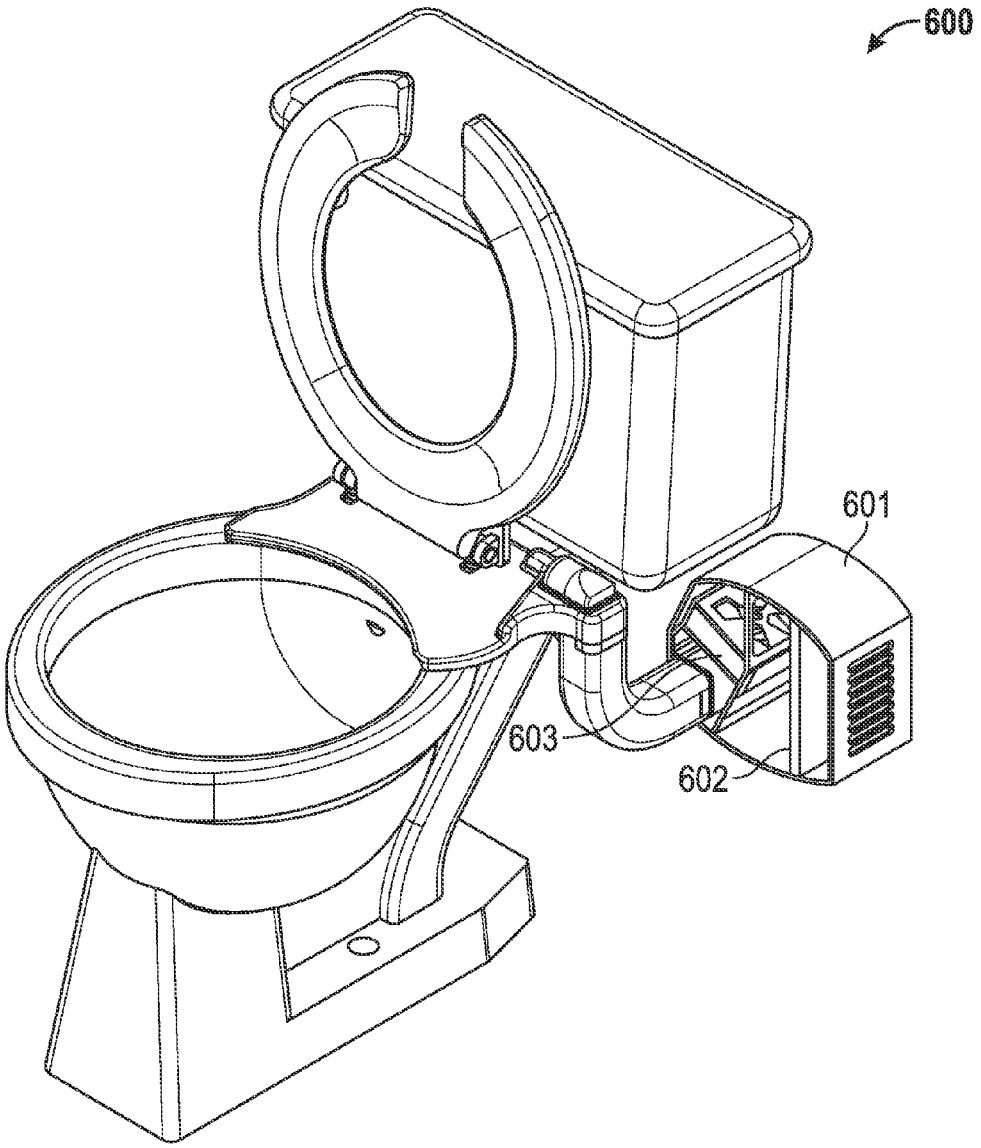
FIG. 11 illustrates an exemplary schematic view of the odor extractor system and integrated filter system, according to an embodiment.
Figure 12:
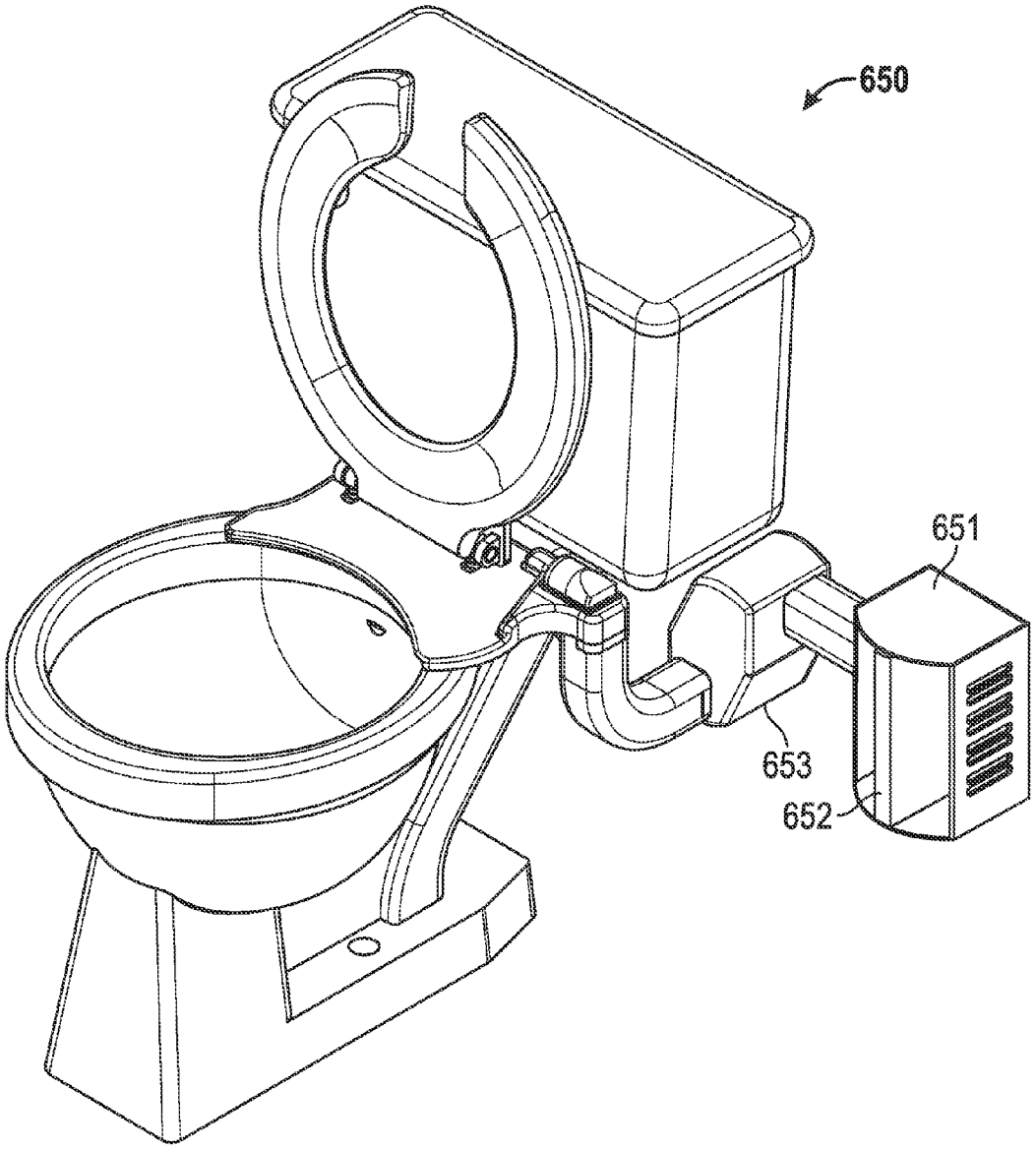
FIG. 12 illustrates an exemplary schematic view of the odor extractor system and filter assembly, according to an embodiment.
Figure 13:
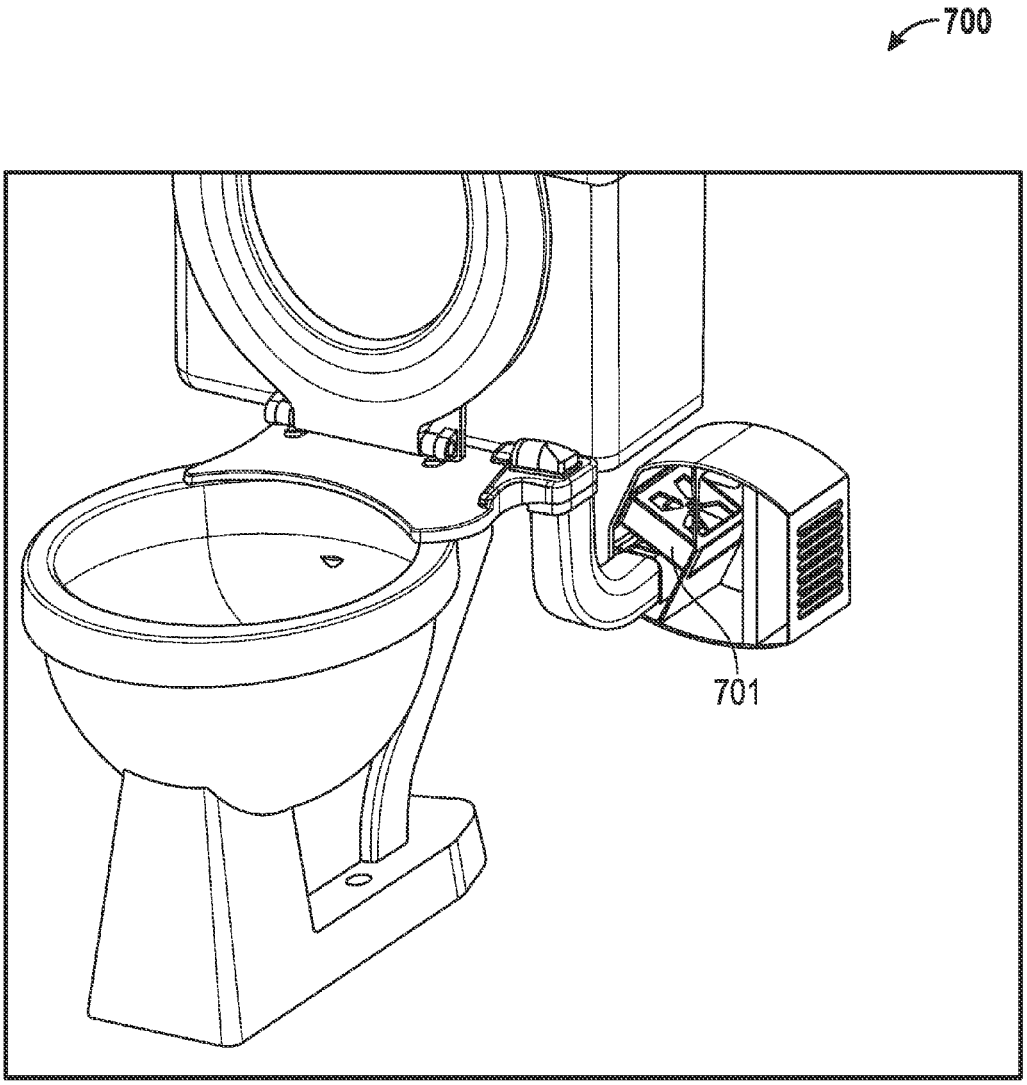
FIG. 13 illustrates an exemplary schematic view of the odor extractor system and filter assembly, according to an embodiment.

FIG. 10 illustrates an exemplary schematic view 550 of the odor extractor system and associated air filter 551, according to an embodiment. In additional to ventilating air, the disclosed embodiments filter the water via the associated of filter 551 that passes through the toilet. FIG. 11 illustrates an exemplary schematic view 600 of the odor extractor system and integrated filter system 601, according to an embodiment. The odor extractor system may integrate a filter system 601, with a filter pad 602 and a motor 603. FIG. 12 illustrates an exemplary schematic view 650 of the odor extractor system and filter assembly 651, according to an embodiment. The odor extractor apparatus 653 is integrated with a separate filter assembly 651 and a filter pad 652. FIG. 13 illustrates an exemplary schematic view 700 of the odor extractor system and filter assembly 701, according to an embodiment.

Figure 14:
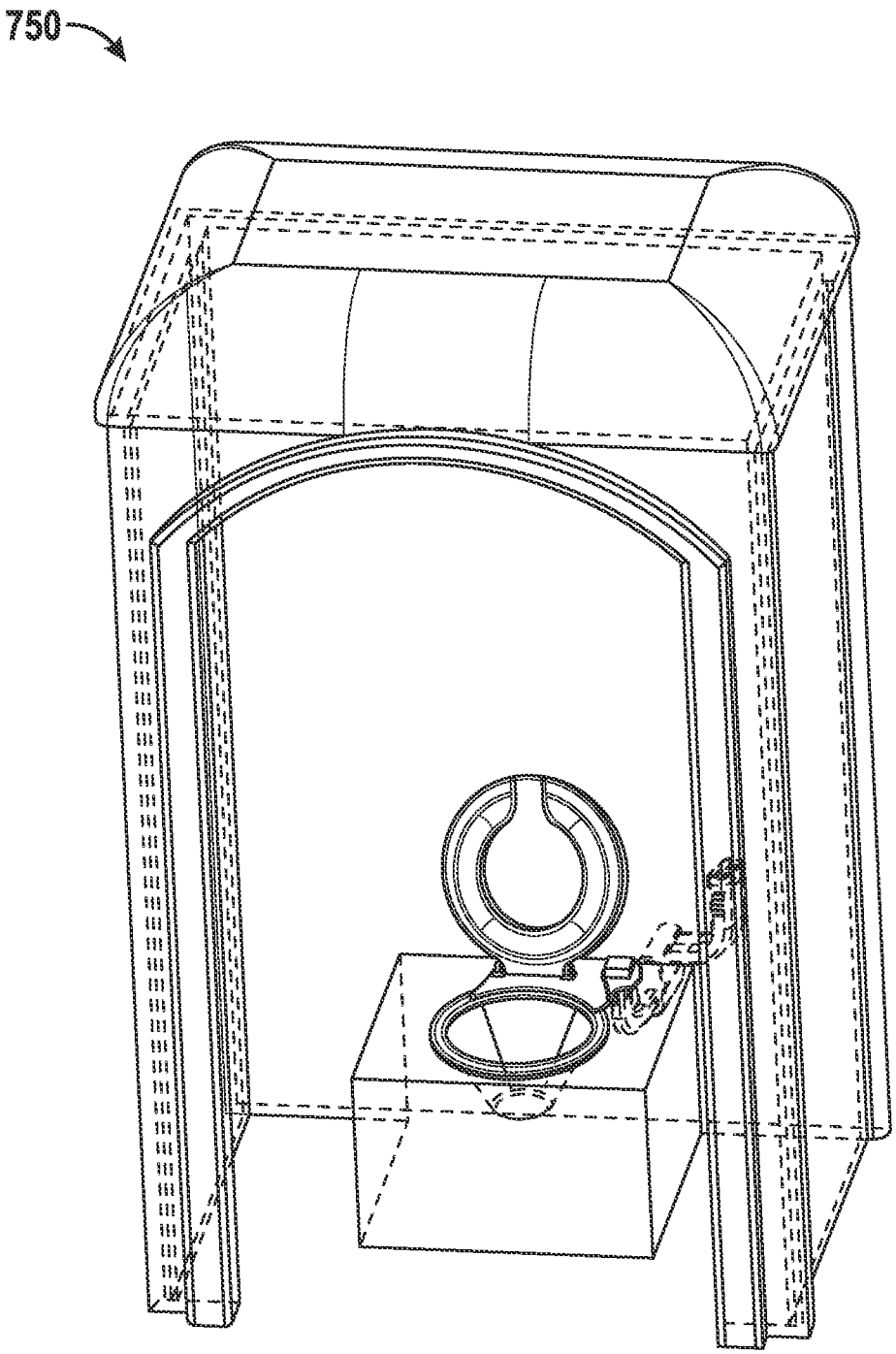
FIG. 14 illustrates an exemplary schematic view of an embodiment of the odor extractor system, according to an embodiment.
Figure 15:
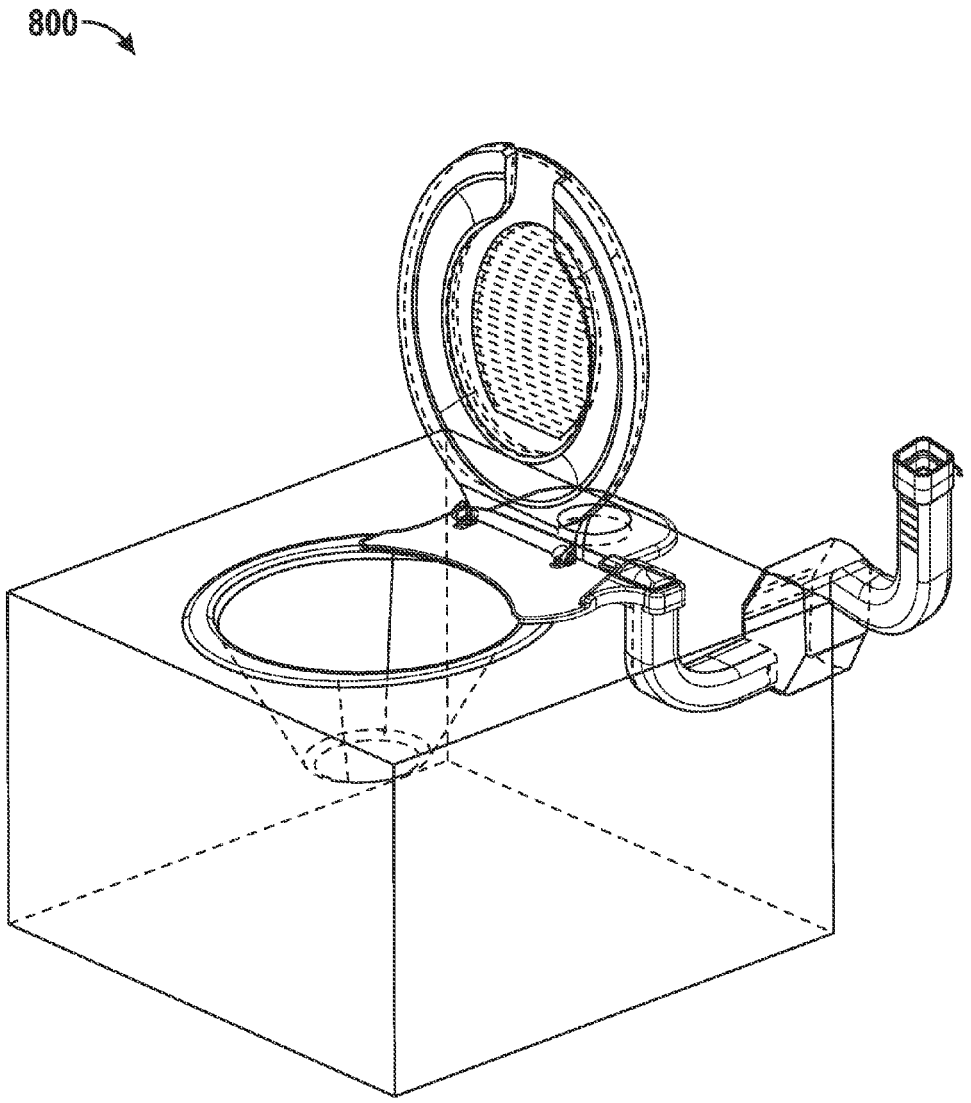
FIG. 15 illustrates an exemplary schematic view of an embodiment of the odor extractor system, according to an embodiment.

FIGS. 14 and 15 illustrate exemplary schematic views 750, 800, respectively, of embodiments of the odor extractor system. In FIG. 14, the odor extractor system is integrated in a free-standing toilet system such as, for example, a portable toilet or a toilet in a beach resort area. In FIG. 15, for example, the odor extractor system is depicted as integrated into a box toilet or rustic toilet. It is understood that the disclosed odor extraction apparatus can be utilized on any size toilet or integrated within the manufacturing process of the toilet itself. The toilet shape and size does not limit the use of the disclosed odor extractor apparatus.

It will be appreciated that variations of the above-disclosed and other features and functions, or alternatives thereof, may be desirably combined into many other different systems or applications. Furthermore, various presently unforeseen or unanticipated alternatives, modifications, variations or improvements therein may be subsequently made by those skilled in the art which are also intended to be encompassed by the following claims.

What is claimed is:

1. An odor extractor apparatus, comprising:

an odor extractor including a output nozzle further comprising a flat plastic component sized to fit between a toilet and a toilet seat mounted to the toilet, the plastic component having a top wall, a bottom wall, and opposing side walls that define an air flow passage there within and having two holes formed therein through the top wall, the air flow passage, the bottom wall, and locate between the side walls to fit a toilet seat mounting hardware located at two locations on a standard toilet, said flat plastic component extending from a first toilet mounting hardware location to a second toilet mounting hardware location and further extending past the second toilet mounting hardware location to one side of the toilet, the flat plastic component further having an air flow slit forming an air flow groove horizontally therein fluidly connect with the air flow passage for drawing odors into the odor extractor and positioned between the toilet and the toilet seat with the air flow groove facing towards a toilet bowl;

a pump contained in a housing having an inlet port and outlet port, wherein the inlet port is adapted to connect to the side of the odor extractor that extends past the second toilet mounting hardware location to one side of the toilet; and a vent connecting the output nozzle of the odor extractor and the inlet port of the housing containing the pump, wherein the pump, vent and odor extractor operate to remove odor from within the toilet bowl.

2. The apparatus of claim 1, wherein the air flow groove is positioned towards the toilet bowl for extracting odor, particles, and bacteria from close proximity to the toilet bowl via the pump.

3. The apparatus of claim 1, further comprising:

a connector to connect the outlet port of the housing to an odor extractor duct penetrating a wall or window to enable odor to flow outside of a room containing the toilet.

4. The apparatus of claim 3, wherein the pump comprises at least one of a vacuum pump, an air extractor, and an electric pump with a turbine engine.

5. The apparatus of claim 4, further comprising a manual switch associated with the pump and located on the odor extractor near the output nozzle, wherein the manual switch is depressed to turn the pump on to draw odor out from a toilet bowl.

6. The apparatus of claim 4, further comprising an automatic sensor associated with the pump, wherein the automatic sensor detects use or prior use of the toilet and turns the pump on to draw odor out from a toilet bowl, and wherein the automatic sensor turns the pump off after toilet use is completed.

7. The apparatus of claim 1, further comprising an air filter associated with the pump, wherein the air filter removes odor emanating from the toilet.

8. An odor extractor system, comprising:

an odor extractor including a output nozzle further comprising a flat plastic component sized to fit between a toilet and a toilet seat mounted to the toilet, the plastic component having a top wall, a bottom wall, and opposing side was that define an air flow passage there within and having two holes formed therein through the top wall, the air flow passage, the bottom wall, and locate between the side walls to fit a toilet seat mounting hardware located at two locations on a standard toilet, said flat plastic component extending from a first toilet mounting hardware location to a second toilet mounting hardware location and further extending past the second toilet mounting hardware location to one side of the toilet, the at plastic component further having an air flow slit forming an air flow groove horizontally therein fluidly connect with the air flow passage for drawing odors into the odor extractor and positioned between the toilet and the toilet seat with the air flow groove facing towards a toilet bowl;

a pump contained in a housing having an inlet port and outlet port, wherein the inlet port is adapted to connect to the side of the odor extractor that extends past the second toilet mounting hardware location to one side of the toilet; and a vent connecting the output nozzle of the odor extractor and the inlet port of the housing containing the pump, wherein the pump, vent and odor extractor operate to remove odor from within the toilet bowl.

9. The system of claim 8, wherein the pump comprises at least one of a vacuum pump, an air extractor, and an electric pump with a turbine engine.

10. The system of claim 8, further comprising a manual switch associated with the pump and located on the odor extractor near the output nozzle, wherein the manual switch is depressed to turn the pump on to draw odor out from a toilet bowl area.

11. The system of claim 8, further comprising an automatic sensor associated with the pump, wherein the automatic sensor detects use or prior use of the toilet and turns the pump on to draw odor out from a toilet bowl, and wherein the automatic sensor turns the pump off after toilet use is completed.

12. The system of claim 8, further comprising:

an air filter associated with the pump, wherein the air filter removes odor emanating from the toilet;

a first connector to connect the extractor nozzle to an odor extractor duct; and a second connector to connect the odor extractor duct to the pump.

13. The system of claim 8, wherein the vent ventilates odor, aerosol particles, and bacteria to an outside environment and comprises at least one of a vertical ventilation outlet, a waft-mounted ventilation conduit, a window-mounted ventilation conduit, a floor-facing ventilation conduit, a horizontal ventilation outlet, and a interior wall-mounted vent.

14. An odor extractor system, comprising:

an odor extractor including a output nozzle further comprising a flat plastic component sized to fit between a toilet and a toilet seat mounted to the toilet, the plastic component having a top wall, a bottom wall, and opposing side walls that define an air flow passage there within and having two holes formed therein through the top wall, the air flow passage, the bottom wall, and locate between the side walls to fit a toilet seat mounting hardware located at two locations on a standard toilet, said flat plastic component extending from a first toilet mounting hardware location to a second toilet mounting hardware location and further extending past the second toilet mounting hardware location to one side of the toilet, the flat plastic component further having an air flow slit forming an air flow groove horizontally therein fluidly connect with the air flow passage for drawing odors into the odor extractor and positioned between the toilet and the toilet seat with the air flow groove facing towards a toilet bowl;

a pump contained in a housing having an inlet port and outlet port, wherein the inlet port is adapted to connect to the side of the odor extractor that extends past the second toilet mounting hardware location to one side of the toilet to pump air for odor removal; and a vent connecting the output nozzle of the odor extractor and the inlet port of the housing containing the pump, wherein the pump, vent and odor extractor operate to remove odor from within the toilet bowl; and an automatic sensor associated with the pump, wherein the automatic sensor detects use or prior use of the toilet and turns the pump on to draw odor out from a toilet bowl area, and wherein the automatic sensor turns the pump off after toilet use is completed.

15. The system of claim 14, wherein the pump comprises at least one of a vacuum pump, an air extractor, and an electric pump with a turbine engine.

16. The system of claim 14, further comprising an air filter associated with the pump, wherein the air filter removes odor emanating from the toilet.

* * * * *